United States Patent [19]

Torgow

[11] 3,933,356

[45] Jan. 20, 1976

[54] TOP AND APPARATUS FOR PLAYING THEREWITH

[76] Inventor: Abraham M. Torgow, 185 E. 206th St., Bronx, N.Y. 10458

[22] Filed: Nov. 29, 1974

[21] Appl. No.: 528,043

Related U.S. Application Data

[63] Continuation-in-part of Ser. No. 341,862, March 16, 1973, Pat. No. 3,863,925.

[52] U.S. Cl. ..... 273/108; 46/65; 46/70; 273/109

[51] Int. Cl.[2] ..... A63F 9/00; A63H 1/12

[58] Field of Search ..... 273/108, 109, 110, 115, 273/147, 101, 128 R; 46/64, 65, 70, 73

[56] References Cited

UNITED STATES PATENTS

| | | | |
|---|---|---|---|
| 1,317,640 | 9/1919 | Nussbeck | 273/108 |
| 2,534,538 | 12/1950 | Thoresen | 273/115 X |
| 2,610,440 | 9/1952 | Manske et al. | 46/70 X |
| 3,191,341 | 6/1965 | Martin | 273/109 X |
| 3,352,055 | 11/1967 | Pelkowski | 46/70 |

*Primary Examiner*—Richard C. Pinkham
*Assistant Examiner*—Harry G. Strappello
*Attorney, Agent, or Firm*—Peter L. Tailer

[57] ABSTRACT

A hand held board has a top spun thereon and then whipped to keep it spinning with a whip provided for this purpose. The size and density of the top is critical to provide a satisfactory whip top that can easily be kept spinning on a hand held board. While a dowel handle with at least a 6 inch soft string whip element attached thereto may be used to whip a top and keep it spinning, a ½ inch strip of sponge or foam rubber as a whip element between 6 and 12 inches long projecting from a suitable handle forms a superior top whip, particularly for a novice.

3 Claims, 8 Drawing Figures

TOP AND APPARATUS FOR PLAYING THEREWITH

CROSS-REFERENCES TO RELATED APPLICATIONS

This application is a continuation-in-part of my patent application Ser. No. 341,862 filed Mar. 16, 1973, now U.S. Pat. No. 3,863,925 and entitled WHIPTOP GAME.

BACKGROUND OF THE INVENTION

1. Field of the Invention

This invention relates to tops and whips that are used to whip them for continued spinning.

2. Description of the Prior Art

U.S. Pat. No. 2,058,692 shows a top and a whip used to keep the top spinning. The top of the instant invention is spun and whipped to keep it spinning on a hand held board. This requires specific design features not suggested by the forementioned patent.

SUMMARY OF THE INVENTION

A top, for use with a whip which is used to keep the top spinning and a hand held board on which the top is spun, has a density between 0.5 and 1.0, is between 1.5 and 3.0 inches high, is between 1.25 and 2.5 inches in diameter with a tapering cylindrical body, and has upper and lower projections that terminate in ends between 3/16 and 9/16 inches in diameter, the projections being less than half the height of the top. The hand held board has a surface that extends at least seven inches in length and width with a handle extending from the center of one side.

In play, the top is spun by its upper projection by one hand on the board which is held by the other hand. When the top is spinning, a whip is used to keep it spinning for an indefinite extended play period. The top is kept on the board by tilting to board to move the spinning top in a desired direction. The spinning top makes a pleasing sound on the board which acts as a sounding board to amplify this sound. The whip striking the spinning top also makes a unique and pleasing sound. The spinning top may be tossed in the air and caught to continue spinning on the board. Other play may be evolved.

The whip may be a dowel with soft string whip elements fixed to one end. The whip elements should be at least 6 inches long and less than 12 inches long. A whip that is easier for beginners to use is formed from a length of ½ inch cardboard tubing from which a ½ inch strip of foam or sponge rubber stripping extends. The rubber whip element should be about 6 inches long for best results. A 12 inch whip element is too long to use effectively and a shorter whip element is harder for beginners to use. A conical handle rolled for use with a flat rubber whip element may be used.

The density and size of a whip top used on a hand held board is important for a whip top which is too dense and heavy will not easily be whipped up to speed and too light a top will be knocked aside and not rotated by whipping. Too small a diameter top is very hard to whip to spin it and too large a diameter top will be spun too slowly when whipped. Further, a whip top must be in a desired height range to be easily whipped and still have spinning stability.

The board should be flat to facilitate the striking of a top spinning thereon with a whip. For easiest whipping, the whip element should be about 6 inches long.

Figure 1:
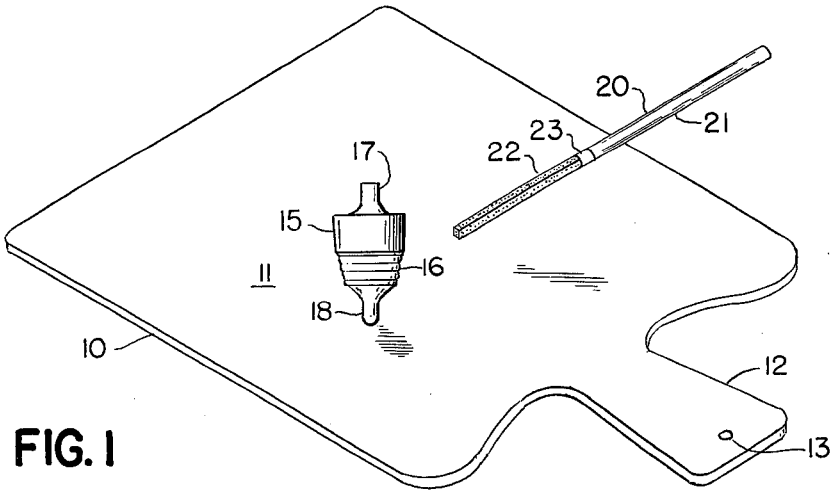
FIG. 1 is a perspective view of a top, a whip, and a board for spinning the top thereon according to a preferred embodiment of this invention.
Figure 3:
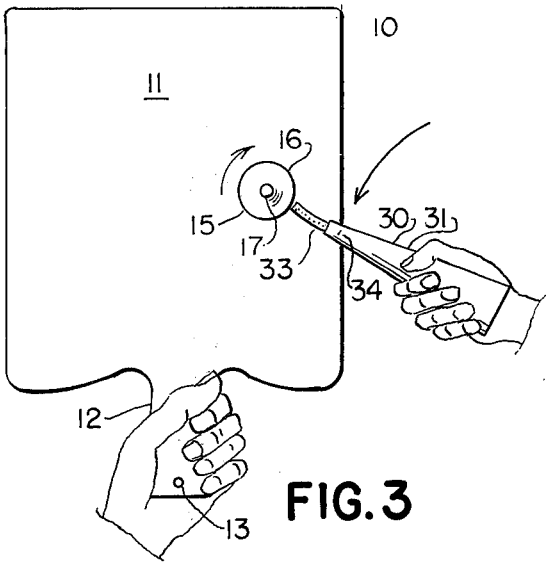
FIG. 3 is a top view of a hand held board on which a spinning top is being whipped by a modified whip.

DESCRIPTION OF THE PREFERRED EMBODIMENTS:

As shown in FIGS. 1 and 3, a hand held board 10 has a substantially square surface 11 from which a handle 12 projects from the center of one side. The entire board 10 may be die-cut from any suitable sheet stock such as ¼ inch or thinner plywood. Surface 11 should measure at least seven inches in length and width to provide a large enough surface to spin and whip a top thereon. A hole 13 for hanging board 10 may be provided in handle 12.

Figure 6:
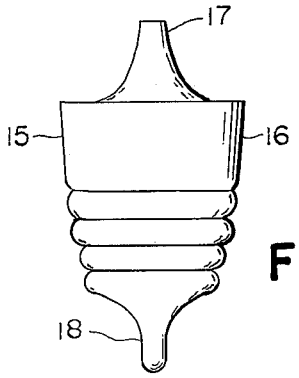
FIG. 6 is a side view of a whip top according to this invention.

As may be seen in FIGS. 1, 3, and 6, whipping top 15 has a substantially cylindrical body 16 which may taper downwards. Body 16 is at least 1¼ inches in diameter and less than 2½ inches in diameter. Upper and lower projections 17 and 18 are between 3/16 and 9/16 inches in diameter as the projections 17 and 18 are hand twirled to initially spin top 15 on board 10. Top 15 should be between 1½ and 3 inches in height with a body 16 being at least half the top height to be able to be whipped while spinning. The density of the top 15 should be between 0.5 and 1.0. While best made from a solid block of turned wood, top 15 may be made from any suitable material.

Figure 8:
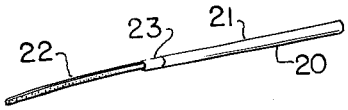
FIG. 8 is a perspective view of a preferred form of a whip to be used with the apparatus of this invention.

As shown in FIGS. 1 and 8, a preferred whip 20 has at least an eight inch handle 21 of ½ inch cardboard tubing from which there projects six inches of a ½ inch square or round sponge or foam rubber whip element 22. A wrapping of tape 23 about whip element 22 and the end of handle 21 secures the whip element 22 to handle 21.

Figure 4:
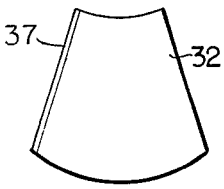
FIG. 4 is a plan view of a blank used to form the whip handle of the whip of FIG. 3.
Figure 5:
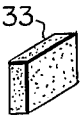
FIG. 5 is a perspective view of the whip element of the whip of FIG. 3.
Figure 7:
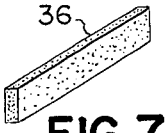
FIG. 7 is a perspective view of a whip element which may be used in the whip of FIG. 3.

As shown in FIGS. 3, 4, and 5, a modified whip 30 has a conical handle 31 rolled from blank 32 which is glued in the rolled form at edge 37. A short two inch whip element 33 of foam or sponge rubber is fixed by stiches 34 or the like to project from handle 31. A handle 31 with a whip element 33 less than 6 inches long requires greater skill to correctly strike a top 15 and keep it spinning without knocking it from hand held board 10. A longer, easier to use, element 36 is shown in FIG. 7 that would project at least 6 inches from a handle 31. A longer whip element of sponge or foam rubber allows less accuracy while satisfactorily whipping and spinning a top.

Figure 2:
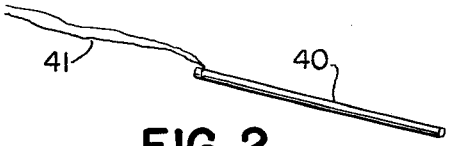
FIG. 2 is a perspective view of a dowel handle with a string whip element which may be used with this invention.

As shown in FIG. 2, a twelve inch dowel 40 has strands of soft cord 41 fixed to extend at least 6 inches from one end to serve as whip elements.

For play, the top 15 must be large enough to be easily whipped while being small enough to be whipped to a high speed of rotation. It must be massive enough to hold a spin for a reasonable time and not be knocked from board 10 when struck by a whip element while being light enough to be rotated by a whip element when struck. The design factors required to provide a whip, a whip top, and a hand held board on which the top is spun are critical.

In use, the board 10 amplifies the hum of spinning top 15. Board 10 may be used to throw spinning top 15 upward and catch it while still spinning. The top 15 may be whipped up to speed and tossed again. Other play can be evolved such as tossing one or more tops 15 between two boards 10. The sound of a whip element 22 on a spinning top 15 is very satisfactory. This carefully designed top 15, its board 10, and whip 20 provide a unique play value.

While this invention has been shown and described in the best forms known, it will nevertheless be understood that these may be changed and modified without departing from the spirit of the invention.

I claim:

1. A top and apparatus for play therewith comprising, in combination, a top having a substantially cylindrical downwardly tapering body at least one half the height of said top, and having upper and lower projections extending from said body to be hand twirled to initially spin said top, a board for spinning said top thereon, said board having a handle extending from one side thereof, and a whip for striking said top while spinning on said board to accelerate the spinning of said top, said whip having a handle and a flexible whip element of foam rubber projecting from said whip handle for striking said top.

2. The combination according to claim 1 wherein said handle is a cardboard tube from within which said whip element projects, and with the addition of a turn of tape about said tube and said whip element securing said whip element to said tube.

3. The combination according to claim 2 wherein said whip element is a ½ inch strip.

* * * * *